US005317887A

United States Patent [19]

Inoue

[11] Patent Number: 5,317,887

[45] Date of Patent: Jun. 7, 1994

[54] BOBBIN TREATING SYSTEM

[75] Inventor: Yasuhiro Inoue, Settsu, Japan

[73] Assignee: Murata Kikai Kabushiki Kaisha, Kyoto, Japan

[21] Appl. No.: 888,731

[22] Filed: May 21, 1992

[30] Foreign Application Priority Data

May 23, 1991 [JP] Japan ..... 3-147826

[51] Int. Cl.[5] ..... D06B 3/09; D06B 23/00

[52] U.S. Cl. ..... 68/5 E; 28/285; 57/281; 57/308; 242/35.5 A

[58] Field of Search ..... 68/5 R, 5 C, 5 D, 5 E, 68/8; 57/281, 308; 242/35.5 A; 28/285; 19/66 R, 66 CC

[56] References Cited

U.S. PATENT DOCUMENTS

| | | | |
|---|---|---|---|
| 1,941,087 | 12/1933 | Hejduk et al. | 28/285 X |
| 3,564,829 | 2/1971 | Tsuzuki | 19/66 R X |
| 4,893,483 | 1/1990 | Kawasaki et al. | 28/285 X |
| 4,953,368 | 9/1990 | Kawasaki et al. | 28/285 X |
| 4,995,230 | 2/1991 | Tone et al. | 68/5 C X |

*Primary Examiner*—Philip R. Coe

*Attorney, Agent, or Firm*—Spensley Horn Jubas & Lubitz

[57] ABSTRACT

In a bobbin treating system connected to a fine spinning frame and an automatic winder, a steam setter is installed inside of the automatic winder for steaming bobbins coming from the fine spinning frame.

12 Claims, 7 Drawing Sheets

BOBBIN TREATING SYSTEM

BACKGROUND OF THE INVENTION

1. Field of the Invention

The present invention relates to a bobbin treating system connected to a fine spinning frame and an automatic winder.

2. Prior Art

Generally, when bobbins are wound with wool yarn or the like on a fine spinning frame and are supplied to an automatic winder, a torque acts on the yarn released, when twisting in a subsequent process. In the bobbin treating system connected between the spinning frame and the automatic winder, there is adopted, for preventing this torque application, a steam setter is provided for steaming the bobbins coming from the spinning frame prior to sending into the automatic winder. (Refer to Laid-Open Japanese Application No. Sho 61-215728.)

The above-described prior-art bobbin treating system, however, has such a problem that, as the steam setter is situated between the location of the fine spinning frame and the location of the automatic winder, a long space will be required between the fine spinning frame and the automatic winder to provide a sufficient time for bobbin steaming, and, in addition, the whole of the system will become large in size.

OBJECT AND SUMMARY OF THE INVENTION

It is, therefore, an object of the present invention to provide a bobbin treating system which is capable of decreasing a space for installing the whole of the system.

According to the present invention, the bobbin treating system connected between the fine spinning frame and the automatic winder is equipped with a steaming apparatus situated in the automatic winder for steaming bobbins coming from the fine spinning frame.

In the present invention, it is possible to reduce the space between the fine spinning frame and the automatic winder by installing the steam setter within the automatic winder, for example on a bobbin transfer line between the winder body constituting the winder and a yarn end finding apparatus.

DETAILED DESCRIPTION OF PREFERRED EMBODIMENT

Figure 1:
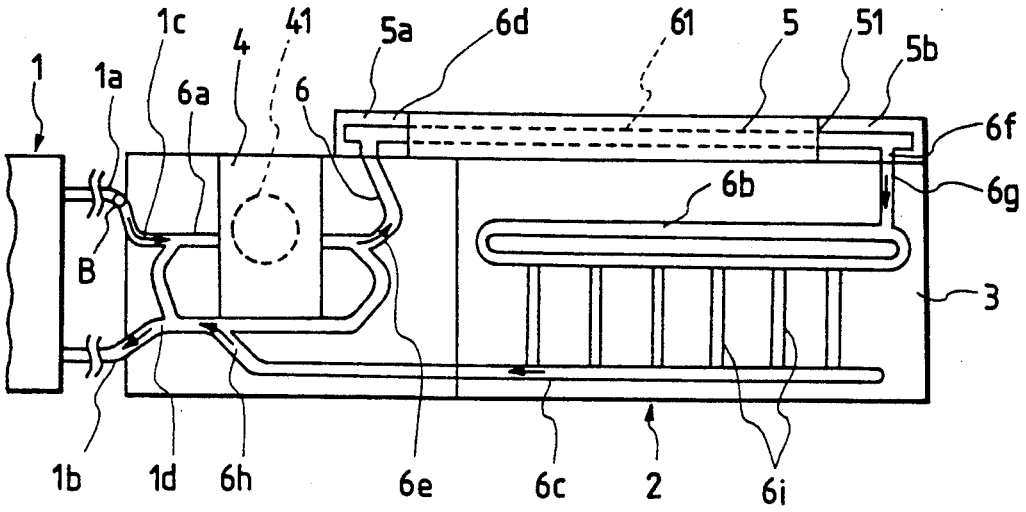
FIG. 1 is a plan view showing one embodiment of the present invention.

FIG. 1 shows one embodiment of the bobbin treating system according to the present invention. This bobbin treating system is equipped with a fine spinning frame 1 consisting of a number of spindles for spinning bobbins B and an automatic winder 2 connected to this fine spinning frame 1, and is designed such that the bobbin B wound on the fine spinning frame 1 will be unwound by the automatic winder 2.

The connection section between the fine spinning frame 1 and the automatic winder 2 consists of a bobbin B incoming line la and a return line 1*b*. In the automatic winder 2 are mounted a winder body 3 consisting of a multiple-spindle winding unit, a yarn end finding device 4 for finding the yarn end on the bobbin B coming from the fine spinning frame 1, a steam setter 5 for steaming the bobbin B coming from the fine spinning frame 1, and a transfer line 6 for transferring the bobbin B.

The transfer line 6 includes a circulating line 6*a* formed between the winder body 3 and the fine spinning frame 1, a feed line 6*b* and a discharge line 6*c* formed along in a longitudinal direction on one and the other sides of the winder body 3, and a connection line 6*d* formed along the longitudinal direction thereof adjacent to one side of the winder body 3. The circulating line 6*a* is connected to an exit section 1*c* of the incoming line 1*a*, an entrance section 1*d* of the return line 1*b*, an entrance section 6*e* of the connection line 6*d*, and an exit section 6*h* of the discharge line 6*c*. The exit section 6*f* of the connection line 6*d* is connected to the entrance section 6*g* of the feed line 6*b*.

On the circulating line 6*a* is disposed the yarn end finding device 4, and on the connection line 6*d* is disposed the steam setter 5. The full bobbin B coming from the fine spinning frame 1 usually flows through the incoming line 1*a*, the finding device 4, the steam setter 5, and the winder body 3, being returned on the return line 1*b* to the fine spinning frame 1.

Figure 2:
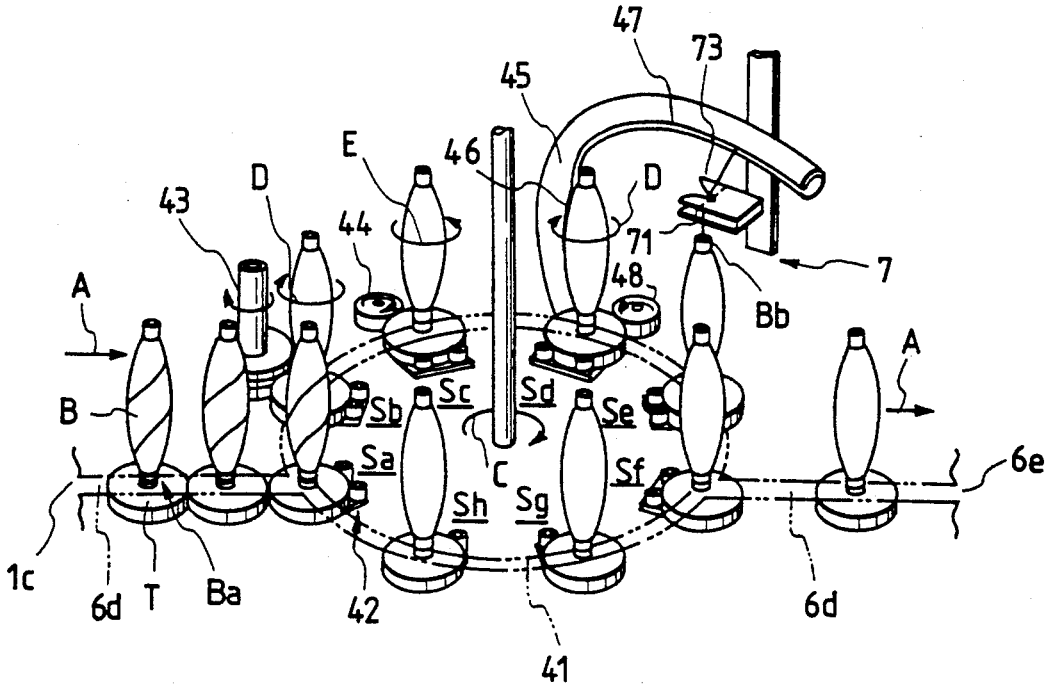
FIG. 2 is a perspective view showing a yarn end finding device.

Next, the yarn end finding device 4 will be explained. FIG. 2 schematically shows the constitution of the yarn end finding device 4. The bobbin B coming from the fine spinning frame 1 is inserted upright in a tray T, and, in this state, is introduced from the exit section 1*c* of the incoming line to the circulating line 6*a*. Then, being carried on the circulating line 6*a* in the direction of the arrow A, the bobbin comes to the receiving position Sa of the finding device 4. In this finding device 4, the bobbin B is received in a tray receiving section 42 formed at a specific pitch on a turntable 41 of the yarn end finding device 4, and then is sent to the treating station Sb with the intermittent rotation of the turntable 41 in the direction of the arrow C. In this station Sb, the bobbin B is turned in a direction D in which the yarn is unwound. A bunch Ba wound on the lower end section of the bobbin is unwound and cut by a cutter 43.

Subsequently, the bobbin B is sent from the station Sb to the station Sc position, and in this position, the rotating roller 44 contacts the tray T, which rotates to turn the bobbin B in a yarn winding direction E. Thus the unwound yarn extending between the bobbin B and the cutter 43 of the station Sb is wound on the yarn layer surface on the bobbin B.

Thereafter, the bobbin B is sent to the station Sd position where a suction mouth 45 for sucking and releasing a free yarn end is disposed. The suction mouth 45 is composed of an approximately L-shaped pipe which has a slit-like opening 46 extending along the bobbin B in the station Sd position and a slit 47 which is connected to this opening 46 and extends upward of the cutter 71 in the station Se position. The base end section of this suction mouth 45 is connected to a suction blower not illustrated. The bobbin B sent to the station Sd position is turned in the unwinding direction by the tray T being driven by a fiction roller 48, with the yarn end being at the same time unwound and inhaled into the suction mouth 45 located adjacent to the surface of the yarn layer. Consequently, the yarn drawn out moves along the slit 47, being stretched between the bobbin B and the slit 47.

Figure 3:
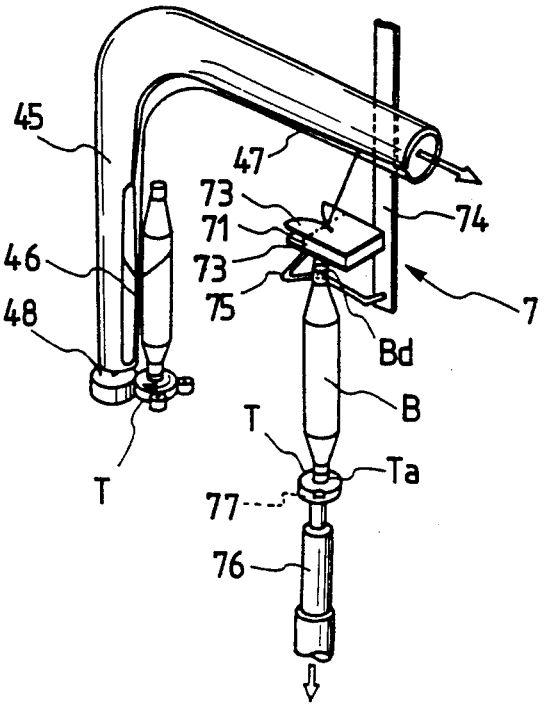
FIG. 3 is a perspective view showing a yarn end inserting mechanism of the yarn end finding device.

Next, the bobbin B is sent to the station Se position. In this station Se position, as shown in FIG. 3, is installed a yarn end inserting mechanism 7 which comprises the suction mouth 45, the cutter 71 for detecting the presence or absence of the yarn drawn out and cutting the yarn to a specific length, and a suction pipe 76 for drawing the yarn end thus cut into the center hole Bd of the bobbin B. When the bobbin B is fed to the station Se position, the yarn drawn out at the station Sd is guided into the cutter 71 by a guide plate 73 which is supported by a support member 74 as one body with the cutter 71, which in turn is operated. At this time, there is flowing a stream of suction air in the suction pipe 76 located beneath the tray T in the station Se position, where the yarn end cut in the cutter 71 position is sucked into the center hole Bd of the bobbin, thus completing the yarn end finding operation. After the completion of the yarn end finding, therefore, a specific length of yarn end is hanging at the bobbin head into the center hole Bd. In FIG. 3, a numeral 75 refers to a guide member for positioning the head of the bobbin B in a specific position for transfer. A peg Ta of the tray T has an air passage (not illustrated) communicating with the center hole Bd and an opening 77 of the suction pipe 76 for the purpose of supplying the stream of suction air from the suction pipe 76 into the center hole Bd of the bobbin B.

The bobbin B, with the yarn end led out, is then sent to a delivery station Sf, from which the bobbin B is further delivered out to the entrance section 6*e* of the connecting line, being sent into the steam setter 5. The bobbin B with its yarn end not found is returned to the receiving station Sa through the bypass stations Sg and Sh.

Figure 5:
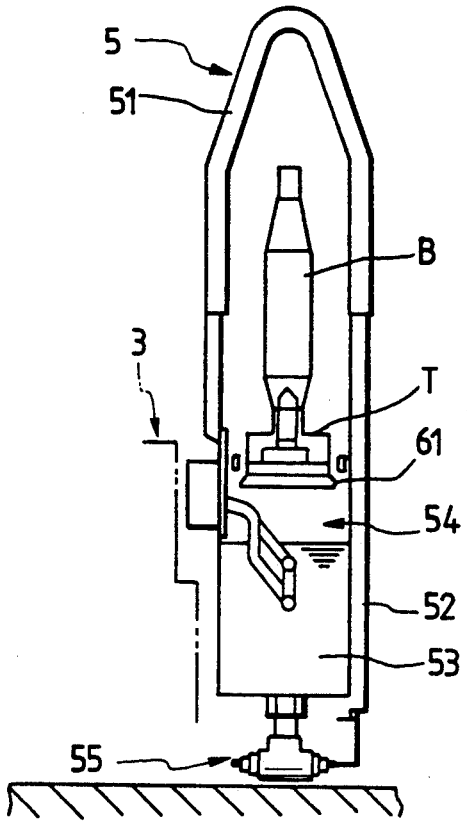
FIG. 5 is a cross sectional view showing the steam setter.
Figure 4:
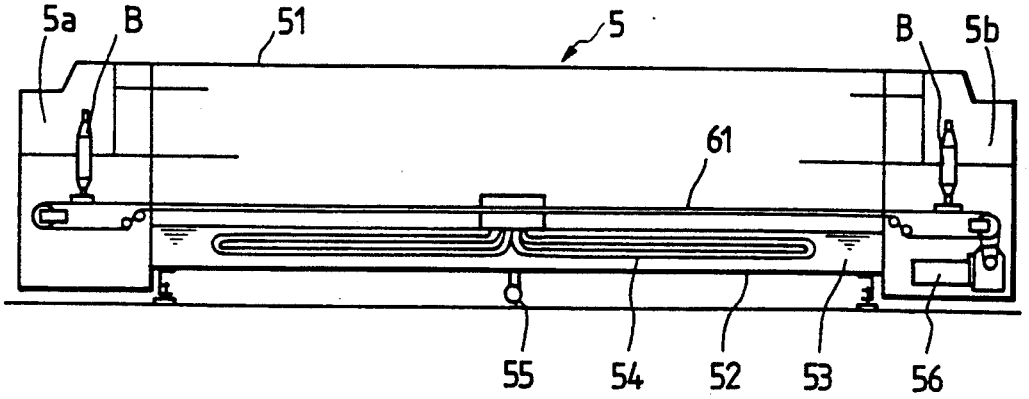
FIG. 4 is a longitudinal sectional view showing a steam setter.

Subsequently, the steam setter 5 will be explained. The connecting line 6*d* with the steam setter 5 is composed of a belt conveyor 61. The steam setter 5, as shown in FIGS. 4 and 5, has a housing 51 which covers the belt conveyor 61. This housing 51 is fixedly mounted on the winder body 3 by bolts at necessary points in the longitudinal direction, integrally with the winder body 3. In the lower part of the housing 51 is mounted a water storage tank 52 below the belt conveyor 61. In this tank 52 is mounted a heater 54 immersed to heat and vaporize the water 53. In the example illustrated, the heater 54 is mounted extending in the longitudinal direction on both sides below the belt conveyor 61. In the drawing, a numeral 55 denotes a plug for supply and discharge the storage water 53, and a numeral 56 is a driving motor of the belt conveyor 61.

Figure 6:
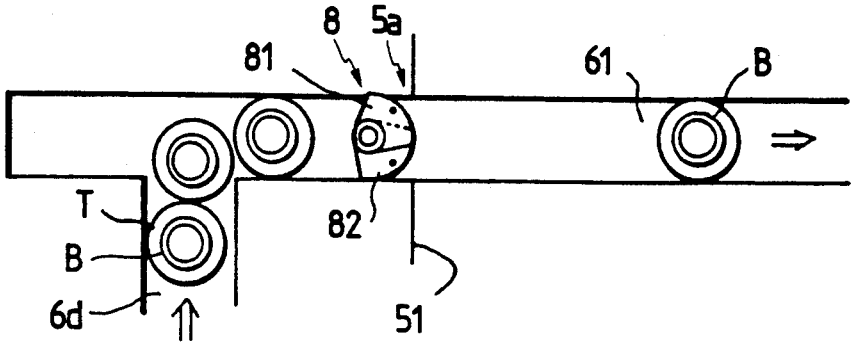
FIG. 6 is a plan view showing an entrance section of the steam setter.
Figure 7:
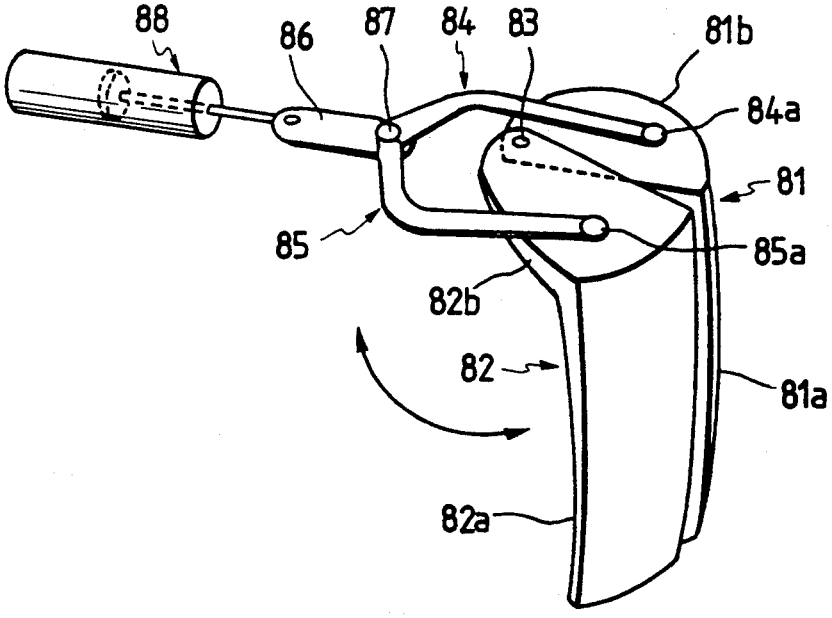
FIG. 7 is a perspective view showing a sealing device.

At the entrance section 5*a* of the steam setter 5, a sealing device 8 is installed for sealing the entrance section 5*a* as shown in FIG. 6. This sealing device 8 is composed of a pair of sealing members 81 and 82 installed end to end in a direction of width at the entrance section 5*a*. As shown in FIG. 7, these sealing members 81 and 82 have circular sections 81*b* and 82*b* which are curved to a circular arc at approximately the same curvature as a flat disk type tray T. These sealing members 81 and 82 are provided at the upper part with bent sections 81*b* and 82*b* which are bent flat to the horizontal direction. These folded sections 81*b* and 82*b* are overlapped with each other and are connected so as to be horizontally rotatable on the center of a pin member 83. To these bent sections 81*b* and 82*b*, the forward ends of L-bent arms 84 and 85 are hinged by pin members 84*a* and 85*a*. These base end sections of these arms 84 and 85 are also hinged to the forward end of a rod 86 by a common pin member 87. The base end section of the rod 86 is connected to a cylinder 88. Therefore the expansion and contraction of the cylinder 88 are changed into a swinging motion for opening and closing the arms 84 and 85 in the horizontal direction, and accordingly the pair of sealing members 81 and 82 are rotated on the center of the pin member 83 toward opening and closing in a direction crossing the entrance section 5*a*.

Figure 8:
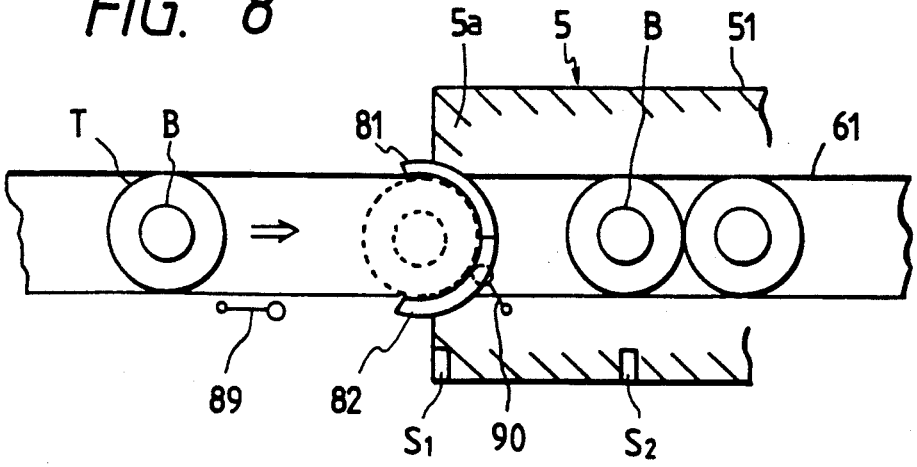
FIG. 8 is a plan view showing bobbins being discharged out at the entrance of the steam setter.
Figure 9:
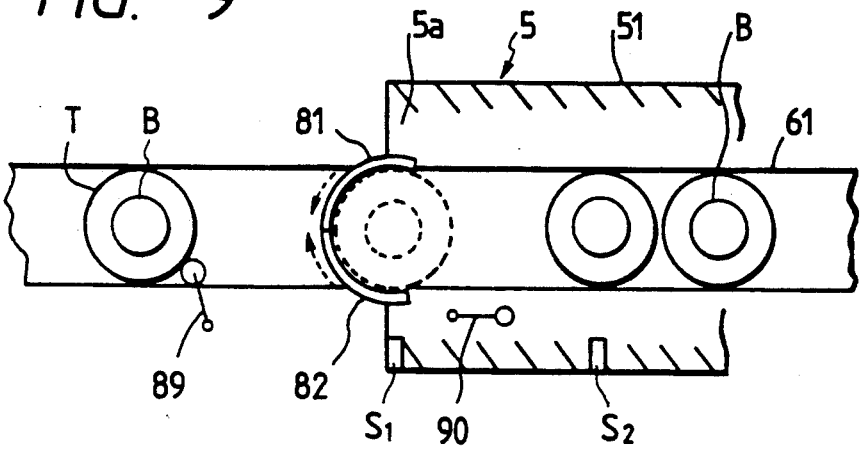
FIG. 9 is a plan view showing bobbins being discharged out at the entrance of the steam setter.

At the entrance section 5*a* of the steam setter are installed, as shown in FIGS. 8 and 9, a first stopper 89 and a second stopper 90, which are releasably engaged with the tray T for discharging the bobbins B one by one. These stoppers 89 and 90 are so designed and constructed as to operate in connection with the operation of the sealing device 8.

Figure 10:
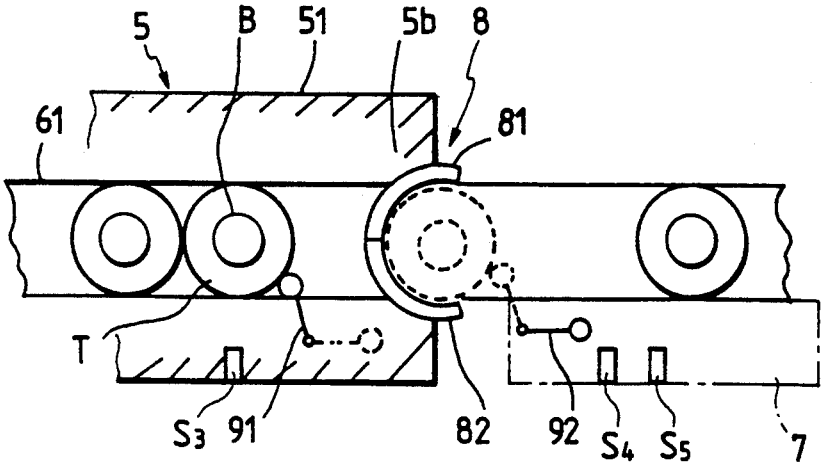
FIG. 10 is a plan view showing bobbins being discharged out at the exit of the steam setter.

At the exit section 5*b* of the steam setter 5 are also installed the sealing device 8, a third stopper 91 and a fourth stopper 92 which operate in connection with each other, as those installed at the entrance section 5*a* as shown in FIG. 10.

Subsequently, the operation of the steam setter 5 will be explained. The bobbin B that has been led into the connecting line 6*d* from the yarn end finding device 4 is once checked from moving as shown in FIG. 9. Thereafter, as shown in FIG. 8, the sealing members 81 and 82 turn to open. At this time when a sensor not illustrated detects that these sealing members are fully open toward the upstream side in the direction of transfer, the first stopper 89 operates to open, permitting the movement of the tray T. Therefore, the bobbin B moves into the sealing members 81 and 82 which were opened into a circular form toward the upstream side in the direction of transfer. Further, as the second stopper 90 is closed in interlock with the opening operation of the first stopper 89, the bobbin B in the sealing members 81 and 82 is checked to move by the second stopper 90.

In this state, when the cylinder 88 contracts, the sealing members 81 and 82 turn reversely on the center of the pin member 83, closing the entrance section 5*a* while opening into a circular form toward the downstream side in the direction of transfer. When the sensor not illustrated has detected the sealing members 81 and 82 fully opened toward the downstream side in the direction of transfer, a second stopper 90 operates to open, allowing the movement of the bobbins B into the housing 51 of the steam setter 5. When the bobbins B are introduced into the housing 51 of the steam setter 5, the entrance section 5a is sealed in a closed state, thus enabling discharging the bobbins B one by one into the housing 51.

The bobbin B thus introduced into the housing 51 of the steam setter 5 is transferred on the belt conveyor 61 toward the exit section 5b over the water storage tank 52, being subjected to steaming with steam supplied from below on the way of travel. Since the water storage tank 52 is set along the belt conveyor 61, all the bobbins B being carried on the belt conveyor 61 are steamed uniformly and sufficiently. After that, the bobbin B that has arrived at the exit section 5b of the steam setter 5 is checked by the third stopper 91 from moving until the lapse of a specific period of time after entrance. That is, the time of entry of each bobbin B into the housing 51 is successively stored by a memory of a control device not illustrated, and a time difference between the current time and the time of each bobbin entrance stored is computed. The third stopper 91 is kept closed until the time difference reaches a specific time, thus checking the movement of the bobbin B.

Next, a controlling method of the steam setter for assuring a constant steam treating time of bobbins which are randomly fed to the steam setter will be illustrated referring to FIGS. 12 to 16.

A stopper 103 and a stopper 104 which are coming into contact with a tray to discharge a spinning bobbin one by one and synchronized with the opening and closing of the sealing device are installed at an entrance section and an exit action of a steam setter 101, respectively. A sensor $S_{101}$ and a sensor $S_{102}$ for detecting a presence of a tray are provided at side portions corresponding to the stopper 103 and stopper 104. When the sensor $S_{101}$ detects the presence of a tray, a solenoid $S_{101}$ is actuated to open the stopper 103 if there is an empty space for a tray in the steam setter 101. When the sensor $S_{102}$ detects a tray, a solenoid $S_{102}$ for operating the stopper 104 is actuated to discharge a tray if the tray stays within the steam setter during a predetermined time.

Figure 13:
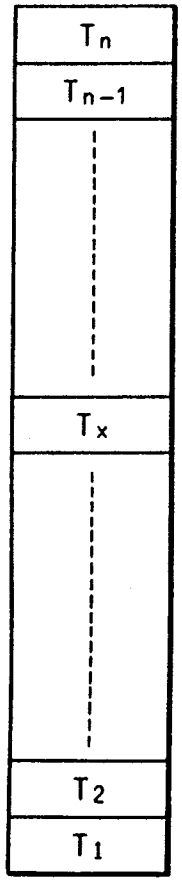
FIG. 13 is a timer table for controlling the steam setter shown in FIG. 12.

The steam treating time of a spinning bobbin in the steam setter 101 is controlled by means of a plurality of preset timer consisting of a control device 105 comprising a microcomputer. The number of the timers is equal to the maximum number of trays which can be stored in the steam setter 101. A timer table for controlling the steam setter is shown in FIG. 13. In FIG. 13, a symbol n designates a maximum number of trays which can be stored in the steam setter 101 and a symbol x designates a present value of number of trays which are present in the steam setter 101. The present value x is increased by one at every time when the solenoid SO1 for operating the stopper 103 is actuated. The timer is one kind of a storing device which is a register with flip-flops and added with a suitable logical circuit and functions to move stored data one by one every time a shift pulse is received. In case that the time of the foremost timer reaches to the predetermined time (about 20 minutes), a shift pulse is received when the solenoid SO2 for operating the stopper 104 is actuated to discharge a tray.

Figure 15:
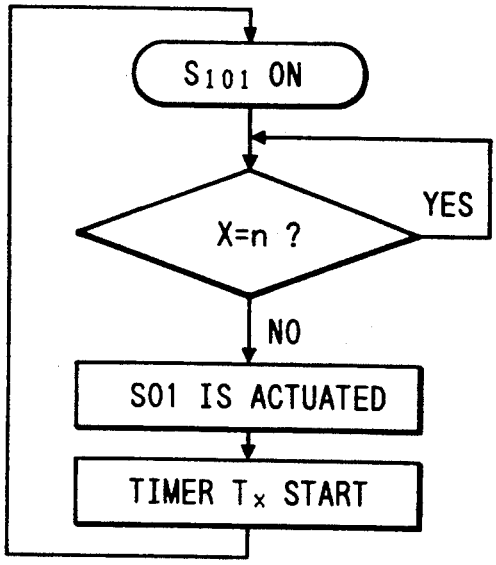
FIG. 15 is a flow chart illustrating an operation at an entrance section of the steam setter.
Figure 16:
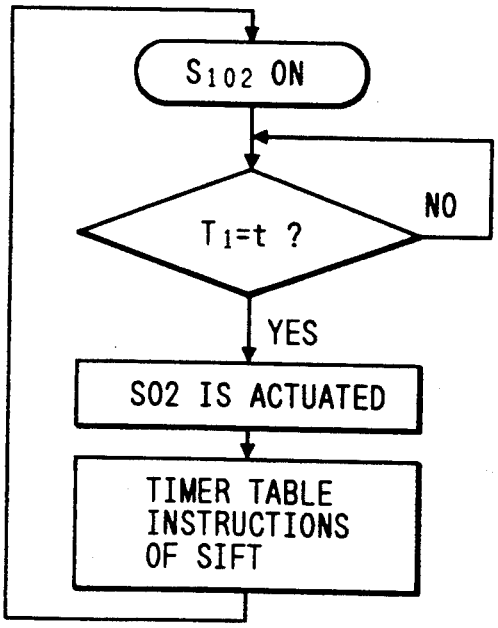
FIG. 16 is a flow chart illustrating an operation at an exit section of the steam setter.

At the entrance section of the steam setter, a tray which is transported from the fine spinning frame side carrying a spinning bobbin is prevented to be moved by the stopper 103. As shown in FIG. 15, when the sensor $S_{101}$ detects the presence of the tray and there is a space for a new tray in the steam setter 101, the solenoid SO1 is actuated to open the stopper 103 and to permit the movement of the tray, and the rearmost timer starts its operation. If the maximum number of trays are stored within the steam setter 101, the solenoid SO1 is actuated at the time when a space for a tray is produced within the steam setter 101 and the same operation as mentioned above is done.

Figure 14:
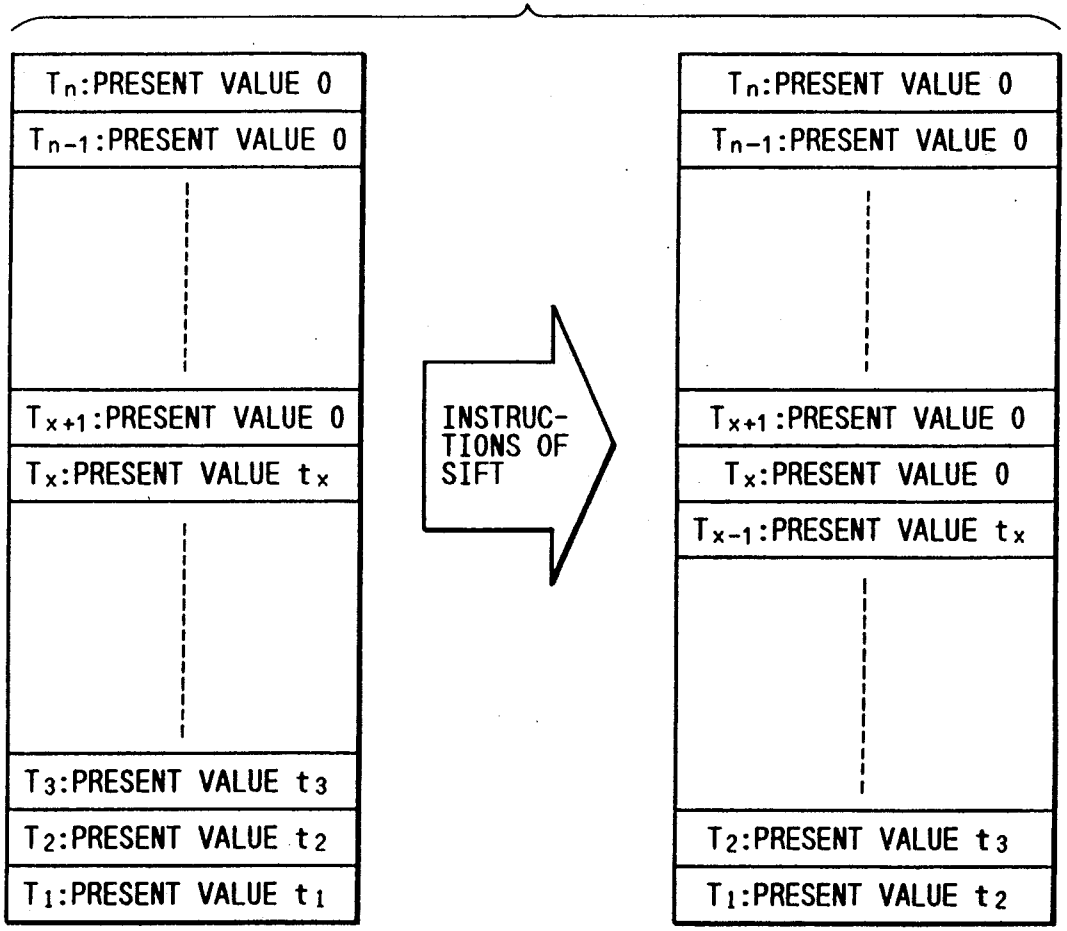
FIG. 14 is a view illustrating a change of a time table when a tray is discharged from the steam setter.

The tray which arrives at the exit section of the steam setter 101 is temporarily prevented to be moved by the stopper 104. If the sensor $S_{102}$ detects the advance of the tray to the position and the time of the foremost timer is the predetermined time t, the solenoid SO2 for operating the stopper 104 is actuated to discharge the tray therefrom and the stored information of each timer is transferred one by one. The change of the timer table (in case that x number of trays are stored in the steam setter 101) is shown in FIG. 14. On the other hand, if the time when the sensor $S_{102}$ detects the advance of the tray does not arrive at the predetermined time t, the actuation of the solenoid SO2 is waited till the time arrives at the predetermined time t. Needless to say, the relation between present value of each timer $T_1, T_2, \ldots T_n$ is $t_1 > t_2 > \ldots > t_n$. According to the controlling method of the steam setter mentioned above, the steam treating time for each bobbin which is randomly fed to the steam setter may be set to be constant and the yarn wound on a bobbin can be adequately processed by steam.

Time required for steaming bobbins B by the steam setter 5 is controlled by means of the shift register which is one type of memory constituting a control device which is composed of a microcomputer not illustrated. This shift register is a register with flip-flops and added with a suitable logical circuit, and functions to move stored data one by one every time a shift pulse is received. In this case, the shift pulse is produced by the opening operation of the second stopper 90. That is, the shift register stores the numbers of bobbins B and a time to discharge the bobbins B into the steam setter 5 every time the second stopper 90 opens, and moves stored data one by one. Also, a time difference between the current time and the bobbin B entrance time stored in the shift register is computed by the control device, thence keeping the third stopper 91 closed until the time difference reaches a specific value.

After the lapse of a specific time from the bobbin entrance time, the third stopper 91 operates to open and the sealing device 8 and the fourth stopper 92 operate in connection with this stopper operation, and the exit section 5b is sealed as in the case of the entrance section 5a, while the bobbins B are discharged out of the housing 51 one by one. A sensor $S_3$ has the same function as the sensor $S_1$. Sensors $S_4$ and $S_5$, which are installed at a spacing of a half pitch as wide as the tray, function to detect that the entrance section 6g of the feed line 6b is full of bobbins B.

The steam setter 5, steaming the bobbins B at low temperatures and at a normal pressure, requires no steam piping nor valve; and therefore it is possible to simplify the construction of the bobbin treating system.

The bobbin B that has been discharged out of the housing 51 of the steam setter 5 flows through the exit section 6f of the connecting line 6d, being introduced into the feed line 6b of the winder body 3. The bobbin B thus introduced into the feed line 6b is sent to an empty space in the discharge line 6c of the winding unit, where the bobbin B is unwound and discharged out to the discharge line 6c, returning to the fine spinning frame 1 through the return line 1b.

Since this bobbin treating system has the steam setter 5 on the bobbin transfer line 6 between the yarn end finding device 4 in the automatic winder 2 and the winder body 3 as described above, the space between the fine spinning frame 1 and the automatic winder 2 can be decreased, thereby enabling saving a mounting space of the bobbin treating system as a whole. Furthermore, since the steam setter 5 is situated between the yarn end finding device 4 and the winder body 3, the yarn end finding operation by the yarn end finding device 4 can be effected with ease. That is, if the steam setter is placed between the fine spinning frame and the automatic winder as in a conventional type, the steam treatment is done prior to yarn end finding and accordingly a steamed wet bobbin is fed to the yarn end finding device, resulting in a hard finding of a yarn end. According to the bobbin steaming system of the present invention, such a problem is solved because the bobbin B from the fine spinning frame 1 first goes into the yarn end finding device and then is subjected to steaming. Therefore the yarn end on the bobbin B can easily be found and led out, thereby diminishing a chance of a failure of yarn end fining. In addition, because this steam setter 5 is formed along the longitudinal direction, close to one side of the winder body 3, it is possible to increase the length of the steam setter 5 while insuring the saving of mounting space and the provision of a sufficient residence time required for steaming.

Figure 11:
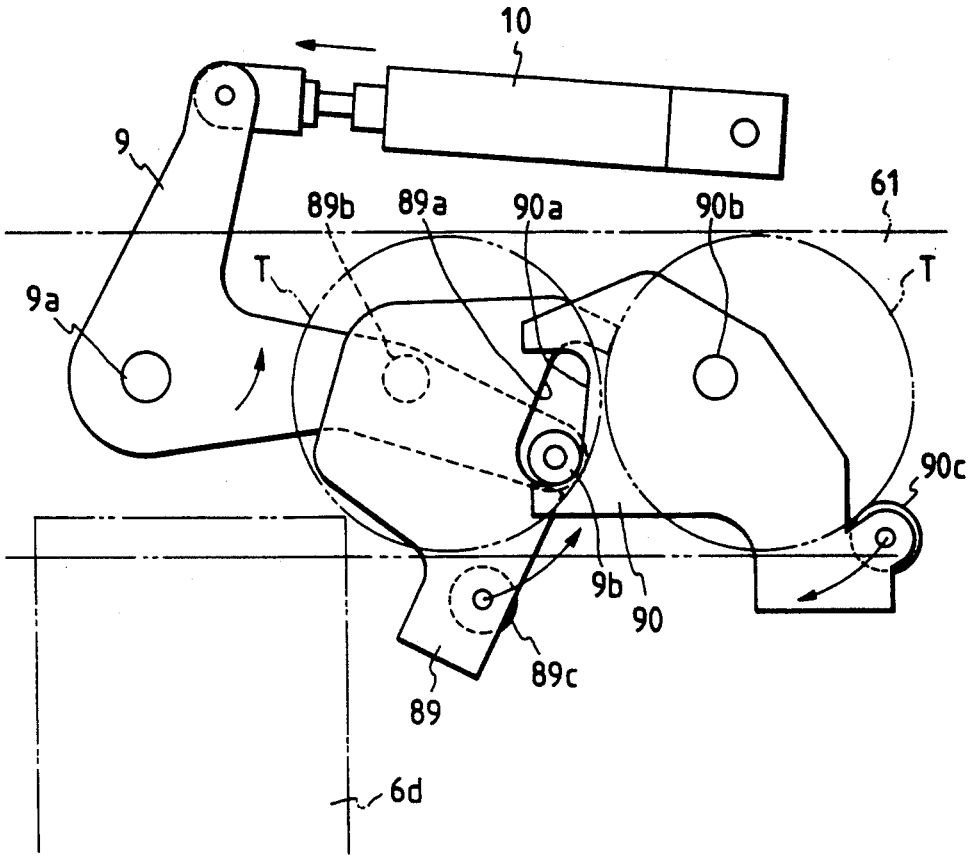
FIG. 11 is a plan view showing a bobbin discharge device at the entrance of the steam setter.
Figure 12:
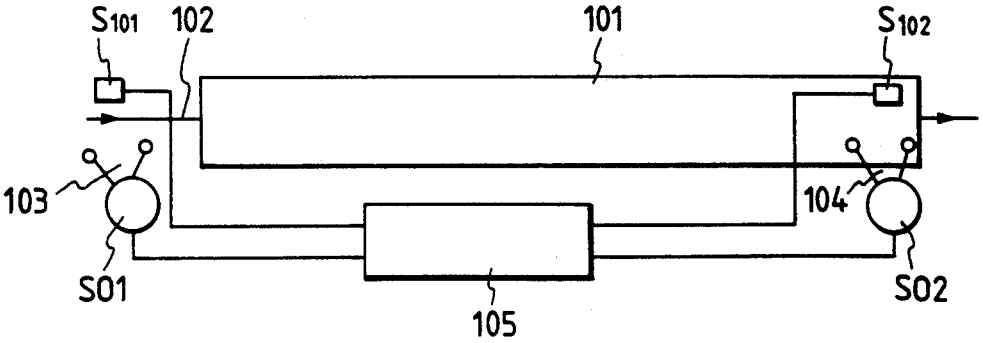
FIG. 12 is a schematic view of a device for controlling a discharge of a tray into or out of a steam setter.

Since the bobbin treating system of the present invention has the steam setter within the automatic winder, it is possible to reduce the space between the fine spinning frame and the automatic winder, thus saving 61 are provided with roller-type projections 89c and 90c. In FIG. 11 the projections 89c and 90c are situated on the outer and inner sides of the belt conveyor 61. When the air cylinder 10 is expanded, the control lever 9 turns counterclockwise on the center of the shaft 9a, thence the projection 9b of the control lever 9 moves inside of the recesses 89a, 90a of the stopper 89, 90. In the recesses 89a and 90a there is a can face forming a part of circular arc rotating on the center of the shaft 9a when the projections 89c and 90c have come inside of the belt conveyor 61. The second stopper 90 is checked from moving by the cam face until the projection 9b has moved about a half of its path, thereafter being rotated in the direction of the arrow by the projection at the end of the can face. On the other hand, the first stopper 89 is turned in the direction of the arrow by the projection at the end of the cam face 89a to about a half of the path of the projection 9b. Thereafter the movement of this stopper is checked by the can face 89a. After the end of movement of the projection 9b, the stoppers 89 and 90 rotate in the direction of the arrow, the position of the projections 89c and 90c in relation to the belt conveyor 61 becomes reverse from the above-described position. In either case, when the projection 89c or 90c is inside of the belt conveyor, the tray T mounted with the bobbin B on the free end thereof are engaged with the recesses 89a and 90a overlapped with each other. The first stopper 89 and the second stopper 90 located correspondingly to the vicinity of one side edge of the belt conveyor the mounting space of the equipment.

Outside of the steam setter 5 is mounted a blower 7 of the present invention for drying off water drops holding on the surface of bobbins B being discharged out from the steam setter 5 as shown in FIG. 10. This blower 7 may be of a small type if it is capable of decreasing the moisture content of yarn as low as twice an official moisture regain or less during a period of about 20 minutes of bobbin B movement.

Next, the bobbin discharge apparatus will be explained by referring to FIG. 11.

The bobbin discharge apparatus of the present invention includes a set of the first stopper 89 and the second stopper 90 and a set of the third stopper 91 and the fourth stopper 92. Both of these sets are identical in basic constitution, and therefore the bobbin discharge apparatus at the entrance side of the steam setter 5 will be explained. As shown in FIG. 11 the first stopper 89 and the second stopper 90 are rotatably mounted on shafts 89b and 90b placed at a spacing in the direction of bobbin transfer, with the recesses 89a and 90a formed in the stoppers 89 and 90 overlapped with each other. In the meantime, on the upstream side of the first stopper 89 and the second stopper 90, a control lever 9 driven to rock by the air cylinder 10 are supported on the shaft 9a. The projection 9b provided is engaged with the projection 89c or 90c, being checked from moving. In either case, an effort to turn the stopper which is in engagement with the tray T acts only in the radial direction of the stopper through the cam face of the stopper recess section, and therefore the stopper remains unrotating. That is, the stopper engaged with the tray T is mechanically interlocked to prevent misoperation in case of ununiform power for bobbin transfer.

What is claimed is:

1. In a system including a spinning frame and an automatic winder having a main body and a yarn end finding device, a bobbin treatment system comprising:

means for moving bobbins from the spinning frame to the winder, including a bobbin transfer line arranged between the yarn end finding device and the main body of the winder, and a steam setter mounted on the automatic winder for steaming bobbins from the spinning frame prior to the bobbins from the spinning frame being delivered to the main body of the automatic winder, the yarn end finding device being operable to find yarn ends on bobbins from the spinning frame prior to the bobbins from the spinning frame being steamed by the steam setter.

2. The system of claim 1, wherein the steam setter defines an entrance section and an exist section and comprises:

a belt conveyor, a housing for covering at least a portion of the belt conveyor, a water storage tank mounted below the belt conveyor and provided with a heater, first sealing means for sealing the entrance section of the steam setter, second sealing means for sealing the exit section of the steam setter, and a bobbin discharge device.

3. The system of claim 2, wherein the steam setter comprises control means for sending a shift pulse to a shift register when a bobbin enters the steam setter, recording the time at which the bobbin enters the steam setter, computing a time difference between the time at which the bobbin enters the steam setter and a current time, and discharging the bobbin from the steam setter when the computed time difference reaches a predetermined value.

4. The system of claim 2, comprising a blower for drying bobbins discharged from the steam setter.

5. The system of claim 2, wherein at least one of the first and second sealing means comprises:

a pair of sealing members that are movable between an open position and a closed position, and means for moving the sealing members between the open position and the closed position.

6. The system of claim 2, wherein the bobbins are supported on trays and wherein the bobbin discharge device defines a direction of tray transfer and comprises:

a control lever having a control lever projection, a first stopper having a stopper projection and a recess for engaging the control lever projection, a second stopper having a stopper projection and a recess for engaging the control lever projection, a first shaft for rotatably supporting the first stopper, a second shaft for rotatably supporting the second stopper, the first shaft and the second shaft being spaced apart in the direction of tray transfer, and means for moving the control lever so that a tray and the stopper projection of at least one of the stoppers are selectively engaged.

7. A bobbin treatment system, comprising:

a spinning frame, an automatic winder comprising a winder body having a plurality of winding units, means for moving bobbins from the spinning frame to the winder, means for moving bobbins from the winder to the spinning frame, a steam setter for steaming bobbins produced in the spinning frame prior to the bobbins produced in the spinning frame being delivered to the winding units, the steam setter including a housing extending along the plurality of winding units, and a bobbin transporting conveyor extending within the housing.

8. The system of claim 7, wherein the steam setter defines an entrance section and an exit section and comprises:

a belt conveyor, a housing for covering at least a portion of the belt conveyor, a water storage tank mounted below the belt conveyor and provided with a heater, first sealing means for sealing the entrance section of the steam setter, second sealing means for sealing the exit section of the steam setter, and a bobbin discharge device.

9. The system of claim 8, wherein the steam setter comprises control means for sending a shift pulse to a shift register when a bobbin enters the steam setter, recording the time at which the bobbin enters the steam setter, computing a time difference between the time at which the bobbin enters the steam setter and a current time, and discharging the bobbin from the steam setter when the computed time difference reaches a predetermined value.

10. The system of claim 8, comprising a blower for drying bobbins discharged from the steam setter.

11. The system of claim 8, wherein at least one of the first and second sealing means comprises:

a pair of sealing members that are movable between an open position and a closed position, and means for moving the sealing members between the open position and the closed position.

12. The system of claim 8, wherein the bobbins are supported on trays and wherein the bobbin discharge device defines a direction of tray transfer and comprises:

a control lever having a control lever projection, a first stopper having a stopper projection and a recess for engaging the control lever projection, a second stopper having a stopper projection and a recess for engaging the control lever projection, a first shaft for rotatably supporting the first stopper, a second shaft for rotatably supporting the second stopper, the first shaft and the second shaft being spaced apart in the direction of tray transfer, and means for moving the control lever so that a tray and the stopper projection of at least one of the stoppers are selectively engaged.

* * * * *